United States Patent [19]

Monselle

[11] 4,003,316

[45] Jan. 18, 1977

[54] ARTICULATED RAILWAY CAR TRUCKS

[76] Inventor: Dale E. Monselle, 116 S. 44th St., Omaha, Nebr. 68131

[22] Filed: Oct. 23, 1973

[21] Appl. No.: 408,469

[52] U.S. Cl. ..... 105/167; 105/182 R; 105/197 A; 105/197 D; 105/208.1; 105/208.2; 105/224 R; 105/224.1

[51] Int. Cl.[2] ..... B61F 3/08; B61F 5/12; B61F 5/26; B61F 5/38

[58] Field of Search ..... 105/182 R, 193, 197 A, 105/197 D, 208.1, 208.2, 224, 224.1, 208, 165, 167, 168

[56] References Cited

UNITED STATES PATENTS

| | | | |
|---|---|---|---|
| 1,640,179 | 8/1927 | Buckwalter | 105/182 R |
| 1,707,046 | 3/1929 | Boyden | 105/165 |
| 1,772,928 | 8/1930 | Kijlstra | 105/182 R |
| 2,009,770 | 7/1935 | Goodwin | 105/208.1 X |
| 2,296,106 | 9/1942 | Holland et al. | 105/167 |
| 2,360,061 | 10/1944 | Jones | 105/167 |
| 2,594,079 | 4/1952 | Settles et al. | 105/208 X |
| 2,609,757 | 9/1952 | Blomberg | 105/197 A |
| 3,211,112 | 10/1965 | Baker | 105/224.1 |
| 3,253,554 | 5/1966 | Tack | 105/193 |
| 3,274,955 | 9/1966 | Thomas | 105/224.1 |
| 3,486,465 | 12/1969 | Munson | 105/197 D |
| 3,517,620 | 6/1970 | Weber | 105/197 A X |
| 3,547,045 | 10/1970 | Cunningham | 105/208.1 X |
| 3,670,660 | 6/1972 | Weber et al. | 105/193 X |
| 3,789,770 | 2/1974 | List | 105/168 |

*Primary Examiner*—Robert J. Spar
*Assistant Examiner*—Howard Beltran
*Attorney, Agent, or Firm*—Neuman, Williams, Anderson & Olson

[57] ABSTRACT

An articulated railway truck assembly is provided with two wheelset assemblies, each of which is attached for pivotal movement about a pivot near the center of the truck frame assembly and each of which extends beneath the respective adjacent ends of the side frames, with resilient support connectors between and joined to the adjacent portions of each wheel frame and side frame for permitting pivotal movement of each wheelset assembly about the respective pivot by resilient deformation of the connectors, whereby the connectors provide restoring forces for returning the wheelsets to the "square" position.

32 Claims, 15 Drawing Figures

ARTICULATED RAILWAY CAR TRUCKS

This invention relates to railway car truck assemblies, and more particularly to improved articulated trucks.

Various railway car truck designs previously have been proposed including variations of three-piece trucks, square or rigid frame trucks, flexible type trucks and articulated trucks. A desirable truck design must satisfy a number of parameters. These include good wheel load distribution, dynamic stability, tracking ability under various loading and road bed conditions, and cost factors including both initial cost and maintenance and operating costs.

Three-piece trucks composed of a bolster sprung on two side frames have been in common use for freight car service for many years in the U.S.. Continued refinement of the three-piece truck has occurred and performance has been quite good, considering the relative simplicity and low initial cost of this truck. With the advent of more severe freight car service requirements, primarily due to increased train-operating speeds and larger cars with higher centers of gravity, requirements have become more demanding for improved operating capabilities of the trucks. Such operational requirements include tracking ability, vertical and lateral ride quality for both lightly and fully-loaded cars, lateral roll stability, reduction or avoidance of wheel hunting motion and of transmission of such motion to the truck frame and car body, and reduction in truck maintenance, particularly dressing or turning of the wheels.

In conventional trucks, the wheels of the trucks are held in a relative "square" and rigid position, i.e., with the two wheel axles parallel and the wheels at each side directly in line with one another. Moreover, in order to provide a centering action of the wheelsets within the rail gauge, the running surfaces of the wheels are of a slightly truncated conical configuration and each wheel is rigidly mounted on the respective axle to prevent any relative rotative motion between the wheels on each axle. A principal result of this arrangement is a tendency for such a truck to travel in an essentially straight path. This serves an obvious advantage on tangent (straight) track, but introduces certain difficulties in negotiating curve track. In negotiating a curve, the outer wheels obviously traverse a rail path of longer length than that traversed by the inner wheels. Except in the case of gradual curves where the effectively larger wheel circumference obtained by both outer wheels running with the flanges closer to the rail is sufficient to guide the truck around the curve, guidance is primarily accomplished by a lateral flange force developed between the outer lead wheel and the rail head, and the truck is in effect "skidded " around the curve. Such a lateral flange force is a function of the angle of attack occurring between the outer lead wheel and the respective rail. Disadvantages of such a curve tracking action are wear of the wheel flange and tread and the railhead, increased rolling resistance, and tendencies for the wheel to climb the rail and attendant risks of derailment.

Where a truck frame has a tendency or a weakness toward relative fore-and-aft movement of the side frames, or so called "parallelogramming", upon contact of the leading wheel with the rail the angle of the attack between the wheel and rail is further increased, and the above-mentioned adverse effects in curve negotiation are further aggravated. Conventional three-piece trucks have such a tendency to parallelogramming.

A highly desirable characteristic for freight car trucks is the ability of each of the wheelsets to align itself with the rail on curves, such that the axis of each wheel axle is aligned with the radius to the track curve at any given point of traverse. Such an action will put the two wheelsets of a four-wheel truck in an angular or turning position relative to one another, in a manner to allow both outer wheels to run with their flanges close to the rail. Advantages of such a tracking characteristic include minimizing wheel flange guiding forces on the outer lead wheel and minimizing tread skidding on all four wheels, with attendant increases in operating efficiency and reductions of wheel and rail wear.

It is an object of this invention to provide an improved railway car truck assembly overcoming the problems and meeting the desirable characteristics outlined above.

It is another object of this invention to provide railway car trucks which are improved over prior trucks and which provide many or all of the advantages of conventional three-piece trucks, particularly relative simplicity of construction, ease of assembly and maintenance, and good load equalizing ability among the wheels.

A more particular object of this invention is to provide improved railway car trucks with good tracking ability on both tangent and curved track, with improved vertical and lateral ride quality for both light and fully loaded cars, improved lateral roll stability, and reduction or elimination of tendencies toward wheel hunting motion or transmission of such motion to the truck frame and car body.

It is a further object of this invention to provide improved freight car truck assemblies which meet the aforementioned objects and which are economical to produce and are rugged and reliable in operation and easy to maintain.

Further and additional objects and advantages of this invention will appear from the description, the accompanying drawings and the appended claims.

In carrying out this invention in one illustrative form, a railway truck is provided comprising a truck frame assembly which includes a pair of side frames in parallel spaced relation to one another and a bolster extending between and supported on the side frames, with the end sections of the side frames extending on each side of the bolster. A wheelset pivoting assembly is provided on each side of the bolster, with each of these wheelset assemblies including a pair of wheels journaled in a wheel frame. Each wheel frame is pivotally connected to the bolster or bolster support structure in the center portion of the truck frame assembly for pivotal movement about a pivot which is spaced a substantial distance from the axis of rotation of the respective pair of wheels. Each wheel frame extends subjacent the respective end sections of the side frames. Resilient connecting means are positioned between and are affixed to each of these end sections and to the respective adjacent portions of the wheel frame. Each of the wheelset pivoting assemblies thereby is movable about the respective center pivotal connection for automatic steering adjustment relative to the truck frame assembly by resilient deformation of the resilient connectors, whereupon the resilient connectors automatically provide restoring forces for returning each wheelset pivoting assembly to the normal parallel or straight-ahead position.

For a more complete understanding of this invention, reference should now be had to the embodiments illustrated in the accompanying drawings and described below by way of examples of the invention. In these drawings, FIG. 1 is a plan view, partially in section, of a railway truck employing teachings of this invention;

Figure 1:
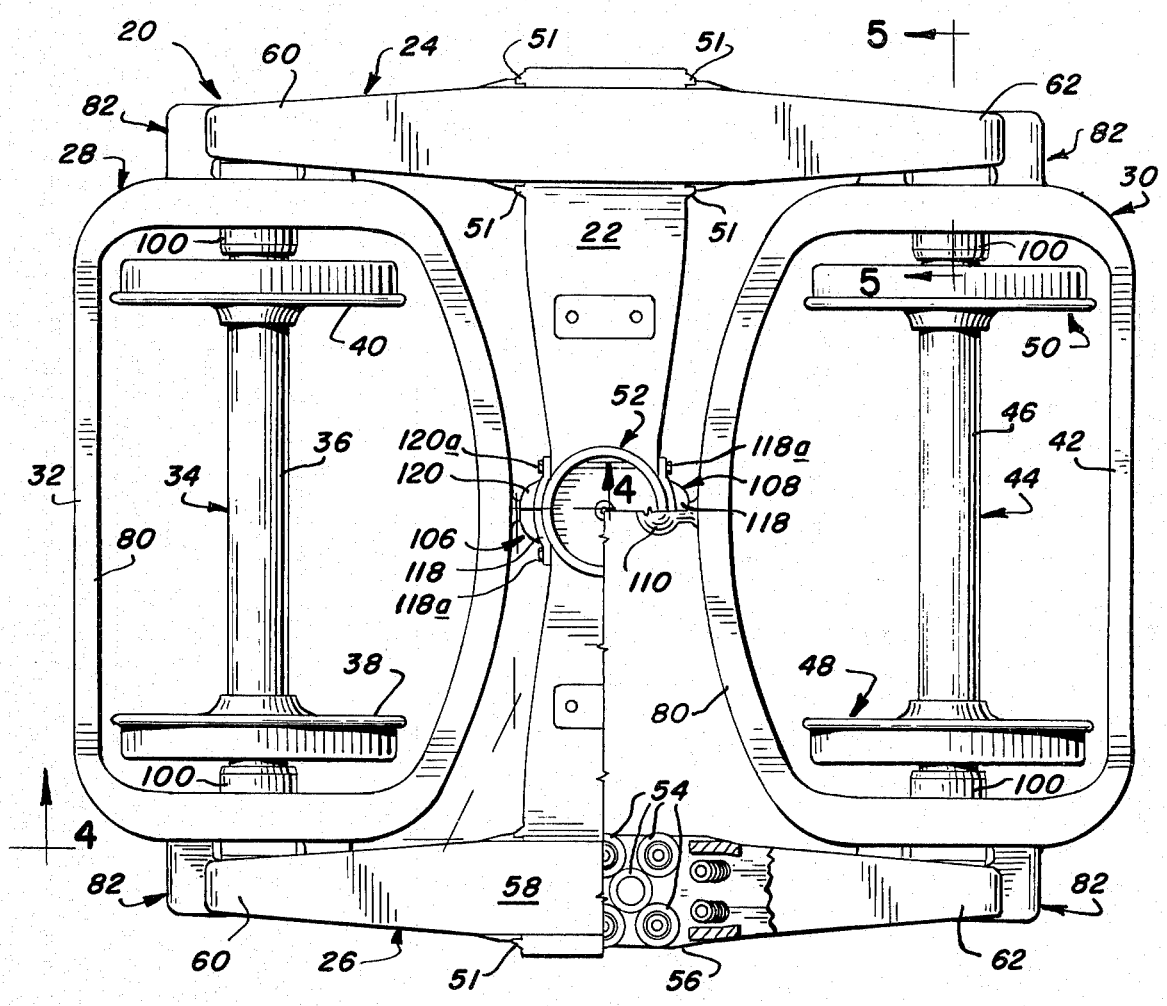

Referring now to the drawings, the truck assembly 20 illustrated in FIGS. 1–7 includes a transverse center support bolster 22, side frames 24 and 26, and two wheelset pivoting assemblies 28 and 30. The wheelset pivoting assembly 28 includes a wheel holding frame 32 in which is journaled a wheelset 34 comprising an axle 36 to which is rigidly affixed a pair of conventional flange wheels 38 and 40. The wheelset pivoting assembly 30 similarly includes a wheel holding frame 42, with a wheelset 44 comprising an axle 46 to which is rigidly affixed a pair of flange wheels 48 and 50. In several of the figures, the upper surface of a railroad rail is represented by a line labeled R.

The bolster 22 includes gib-like retainers or guides 51 on each side of the side frames, and is provided with a conventional center bearing structure at 52 for receiving the king pin and bearing plate of a railway car (not shown) to be supported on the truck assembly 20. The bolster is of a length somewhat greater than the length of the bolster in a conventional three-piece truck and is supported on the side frames 24 and 26 in the general manner of a conventional basic three-piece freight car truck assembly. Each end of the bolster 22 is supported on a set of springs 54. The springs in turn are supported on the lower chord 56 of the respective side frame, see FIGS. 1 and 2.

The side frames 24 and 26 are of a truss design in which the center section includes the lower chord 56, and an upper chord 58, with oppositely extending end sections 60 and 62 for bearing support on the respective wheelset pivoting assemblies. Friction wedge blocks 64 are supported within pockets provided in the respective vertical struts or columns 65*a* and 65*b* of the side frame members, there being such a wedge block on each side of the bolster end within each side frame. Each wedge block 64 is urged upward by a pair of compression springs 66 supported on the lower chord section 56, with each wedge block having friction-bearing engagement with an adjacent wear plate 68 installed in the vertical side surface of the respective bolster end and being contained by an opposing wear surface 70 forming a part of the wedge block containing pocket which is a part of the respective side frame. These blocks maintain relatively constant fore-and-aft forces against the truck bolster, and the frictional engagement of the blocks with the bolster provides snubbing or damping action of bolster movement relative to the side frame both vertically and laterally (transverse to the tracks). The friction wedge block arrangement also tends to hold the side frames in a square or right-angular relationship with respect to the bolsters. The friction wedge block arrangement of the assembly 20 is similar in overall configuration to wedge block systems employed in present stabilized three-piece truck designs. However, in the assembly 20, extra width of the side frames, which also may provide the required strength for relatively longer lengths of the side frames, accommodates a pocket of a width permitting the wedge blocks to be of considerably greater length (as measured transverse to the tracks) to provide an extra measure of the squaring effect between the side frames and bolster.

Figure 2:
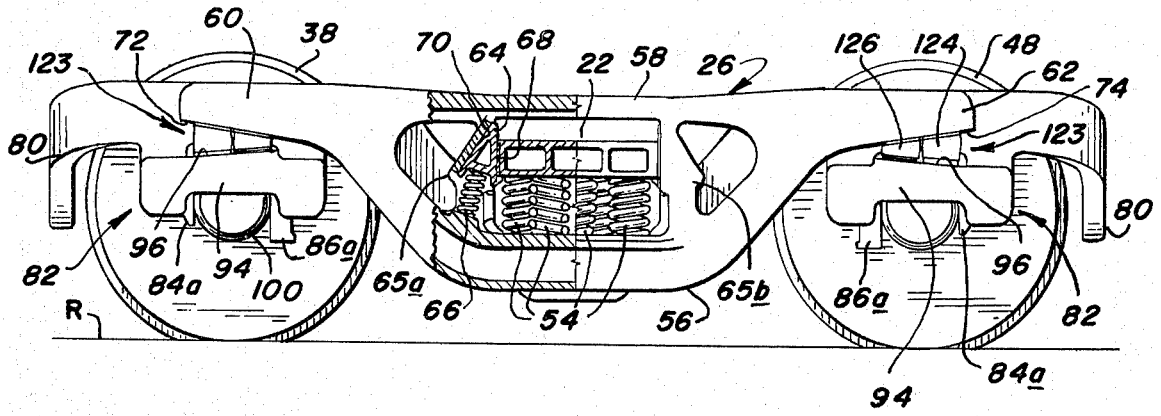
FIG. 2 is a side view, partially in section, of the truck assembly of FIG. 1.
Figure 3:
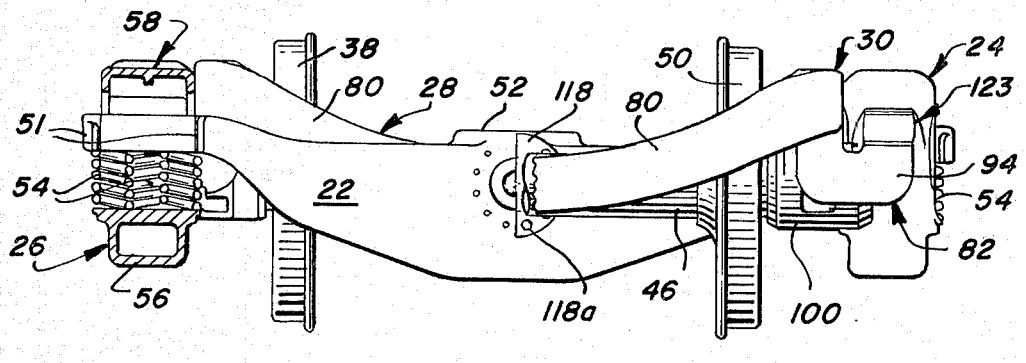
FIG. 3 is an end view, partially in section, of the truck of FIG. 1.
Figure 6:
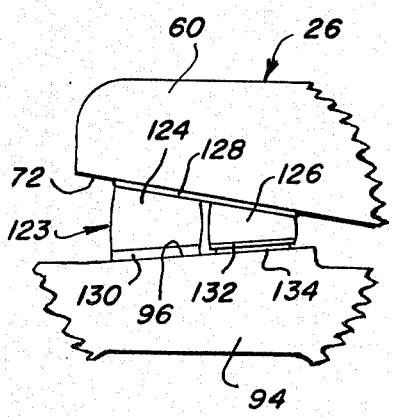
FIG. 6 is an enlarged elevation view of a portion of the truck of FIG. 1, illustrating the resilient mounting arrangement.

The lower surface of each end section 60 and 62 of each side frame is of a configuration to provide a planar bearing surface which is inclined upwardly from the horizontal in a direction away from the bolster, as seen at 72 and 74 in FIGS. 2 and 6.

Figure 4:
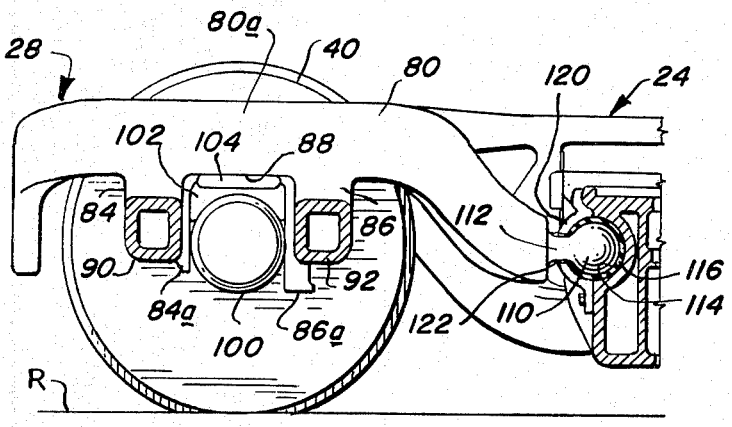
FIG. 4 is an enlarged partial elevation view, taken generally along the irregular line 4—4 of FIG. 1.
Figure 7:
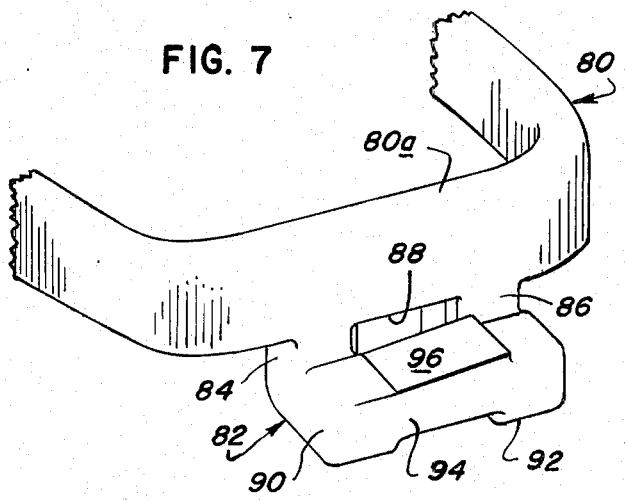
FIG. 7 is an enlarged perspective view of the support section of a wheel frame of the truck of FIG. 1.

Referring further to the wheelset pivoting assemblies 28 and 30, each wheel holding frame 32 and 42 comprises a unitary structure, preferably a casting, including a generally D-shaped main frame portion 80 with depending pedestal opening and load support structures 82 at each end. Referring particularly to FIGS. 2, 4 and 7, each pedestal opening and load support structure 82 includes a pair of short pedestal arms 84 and 86 extending downwardly from a longitudinal end portion 80*a* of the frame member 80. Short support arms 90 and 92 extending horizontally outward from the pedestal arms 84 and 86 merge with a longitudinally extending support bar 94. Each bar 94 is provided with a planar upper support surface 96 which extends at a shallow angle of decline relative to the horizontal in a direction away from the bolster 22. As shown in FIGS. 2 and 4, the pedestal arms 84 and 86, together with the intervening lower surface 88 of the frame portion 80*a* and pedestal arm extensions 84*a* and 86*a* form the pedestal opening.

Figure 5:
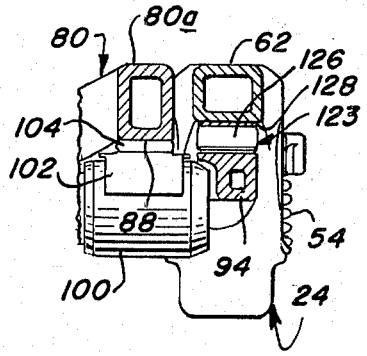
FIG. 5 is an enlarged view, partly in section, taken generally along line 5—5 of FIG. 1.

Referring now also to FIGS. 4 and 5, a bearing 100 is provided on each outer end of each axle 36 and 46. A bearing adaptor 102 rests on each of the bearings 100. The bearings 100 and adaptors 102 may be of conventional construction. In each of the wheelset assemblies, the bearing and adaptor components at each end of the axle of the wheelset are received in mating, longitudinally confined engagement within the pedestal opening of the pedestal and load support structure or bracket 82 at the respective side of the wheel frame, as illustrated. An elastomeric pad 104 also is installed between each pedestal surface 88 of each wheel frame and the respective bearing adaptor 102. The pad 104 provides vertical elastic cushioning between each wheel frame and the respective wheelset, and allows for some elastic springtype lateral movement between each wheelset and wheel frame. The adaptor pads 104 may be of designs presently commercially produced for use in conventional three-piece trucks.

The wheelset pivoting assemblies 28 and 30 are pivotally attached to the bolster 22 through a pair of ball and socket assemblies 106 and 108. Each of these ball and socket assemblies includes a ball component 110 which preferably is cast integrally with the respective frame 32 or 42, being joined to the center of the respective frame through a neck portion 112. Referring particularly to FIG. 4, the bolster 22 is formed with hemispherical recesses 114 in its forward and rearward surfaces to receive the two balls 110. These recesses are centrally located with respect to the length of the bolster so that they are located on the longitudinal centerline of the truck assembly. The balls 110 are received in these recesses, with intervening hollow sphericallyshaped elastomeric seat members 116. Each ball is retained in this seating position, while allowing for limited pivotal movement in all directions, both laterally and vertically, by a pair of matching right and left ball retainer members 118 and 120. The members 118 and 120 have inner surfaces which are complementary to the respective recess 114 for completing the socket connection. The members 118 and 120 define an opening 122 around each connecting element 112 which is slightly larger than the connecting element to permit movement of element 112 for the angular pivotal movement of each wheelset pivoting assembly relative to the bolster 22. The shell or retainer members 118 and 120 are suitably secured to the bolster 22, as by bolts 118*a* and 120*a*.

The planar support surfaces 96 of the wheelset pivoting assembly 28 are positioned in subtending registry relative to the planar surfaces 72 on the respective adjacent ends of the side frames 24 and 26, while the corresponding support surfaces 96 of the wheelset pivoting assembly 30 are in similar subtending registry with respect to the support surfaces 74 on the respective adjacent ends 62 of the side frames. Moreover, as is seen particularly in FIGS. 2 and 6, each such pair of opposed planar support surfaces extend in diverging relationship to one another in a direction outwardly from the bolster 22.

A wedge-shaped elastomeric connector and mount assembly 123 is provided between each pair of opposed support surfaces 72-96 and 74-96. Each of these mount assemblies includes two wedge-shaped elastomeric blocks 124 and 126. The outer block 124, which is of a greater height than the inner block 126, is attached, as by bonding, both to an upper mounting plate 128 and to a lower mounting plate 130. The inner block 126 is similarly affixed to the upper plate 128, which forms a common upper mounting plate for both blocks, and is further secured to a second lower plate or friction plate 132. The plate 132 has sliding frictional engagement with an opposed wear plate 134 which is affixed to the support bar 94 on surface 96. Mounting plate 130 also is affixed to the surface 96 of support bar 94, while the upper mounting plate 128 is affixed to the opposed support surface 72-74 of the respective side frame. Thus the outer elastomeric blocks 124 at the four mounting positions adjacent the respective wheel bearings provide elastomeric connections between the wheel set assemblies and the side frames.

It will be appreciated that under normal free pivotal operating conditions, the entire load being carried by the trucks is transferred through the elastomeric mounts which are positioned directly over and adjacent the wheel bearings. None of the vertical forces generated by the car load are transferred through the ball joint connections. Thus the ball and socket joint connections between the wheel frames and truck bolster may be designed to withstand essentially only those forces or loadings exerted by the wheel frames under conditions of wheel braking, car coupling impact, and wheel frame articulation movement.

Because the wheel frames 32 and 42 are connected to the truck bolster 22 at pivot points which are fixed relative to the bolster, vertical movement of the bolster such as occurs under different static and dynamic car loading conditions and attendant compression and extension of the springs 54 will move these pivots, i.e., the ball and socket assemblies 106 and 108, up and down. Since the vertical position of each wheel frame is essentially constant in the vertical plane of the respective wheel axle, the vertical movement of the bolster will cause a vertical angular or rocking movement of each wheel frame on the respective wheel axle. The different relative angular positions thus assumed by each wheel frame will cause a corresponding change in the relative angular position of each pair of opposed surfaces 72–96 and 74–96. Increased loads will cause downward deflection of the bolster, which will result in a decrease in the included angle between these opposed surfaces, while lighter loading will result in upward movement of the bolster, and attendant increase in this included angle. By way of example, changing from a spring free to a light car loading may rotate the wheel frame and thus the surfaces 96, through an angle of about ¾° while changing from a light car loading to a fully loaded car situation may cause an additional rotation of approximately an additional 3°.

Changes in the included angle between the opposed mounting surface 72–96 require different amounts of relative vertical movement of various portions of the opposed surfaces toward and away from one another due to the differences in radial distance from the pivots 106–108 to the respective portions of the surfaces. The elastomeric blocks 124 and 126 are of tapered end or truncated wedge configurations, preferably corresponding in longitudinal section in the free state to the angle formed between the opposed mounting surfaces under the truck spring free loading condition. Due to this tapered configuration of the blocks, greater thicknesses of the elastomeric material are provided between the opposed surfaces having the greater amounts of relative movement toward and away from one another, thereby maintaining a relatively uniform vertical compression stress distribution throughout the elastomeric blocks and over the respective opposed support surfaces through the entire range of design truck loading, e.g., from "spring free" or no load to total spring or "spring solid" load condition. As a result, a relatively balanced or uniform loading will be maintained on each mounting bracket of the wheel frames over the entire design load range of the truck. By way of specific example, the slopes of surfaces 72, 74 and 96 may be chosen to equally divide the included angle between the opposed surfaces when in a spring free loading condition i.e., each surface at an equal but opposite angle to the horizontal relative to the opposed surface. Using an exemplary wedge block angle of 17½°, each upper and lower surface of the blocks, and the related surfaces to which the blocks are attached, would be at an angle of 8¾° to the horizontal in the spring free condition, with surfaces 96 pivoting to 8° and 5° positions under the loading movement parameters noted above.

The placing of elastomeric connections at the load transfer points between the side frames and the wheelset pivoting assemblies in the manner indicated, together with the pivotal connection of each wheel set pivoting assembly to the bolster, provide an advantageous automatic steering compensation and load adjustment arrangement. Since the outer elastomeric blocks 124 of each mount assembly are joined both to the respective side frame and to the respective wheel frame, these blocks 124 provide smooth resilient spring elastic restraint between these joined components in a horizontal plane, i.e., both longitudinally and laterally of the truck assembly. The inner blocks 126 also provide a degree of similar resilient elastic restraint in a horizontal plane, within the limits of the frictional sliding restraint between the lower mounting or friction plate 132 and the opposed wear plate 134 of the wheel frame. Beyond those limits, a Coulomb damping action is provided due to the frictional sliding movement between the plates 132 and 134. Because each mount assembly 123 is a load carrying or transfer assembly, the forces developed normal to the friction plate 132 and the wear plate 134 and the attendant Coulomb damping produced by sliding motion between these plates will be generally proportional to the truck loading.

The load distribution across the mounts may be controlled at specified loading conditions by changing the wedge block angle. For instance, it may be desirable to maintain a greater proportion of the load on inner blocks 126 under light car loading conditions to enhance the noted damping effect obtained through plates 132 and 134 under that load condition. This enhancement may be accomplished by providing a slight deficit in the included angle of the wedge block relative to the included angle between the mounting surfaces on the side frames and wheel frames.

Due to the outward and downward slope of each wear plate 134, the net vertical load force transferred through the plates 132 and 134 will generate opposed longitudinal force components acting on the two plates which will tend to cause relative sliding motion between these two plates longitudinally of the truck, i.e., along the direction of motion of the wheel frame brackets relative to the side frames. The directions of these longitudinal force components are such as to tend to produce a longitudinally outward sliding movement of the plate 132 and a corresponding inward sliding movement of the plate 134, i.e., tending to cause inward motion of the mount members 96 (toward the transverse center plane of the truck). Moreover, this tendency will be enhanced under lighter truck loading conditions, due to the relatively greater angle between the opposed angular mounting surfaces under lighter loading conditions. This preferred direction of sliding motion will tend to oppose any curve outward steering tendency of the linkage system of this truck arising from lateral loading on the bolster toward the inside of a curve when the car is standing or slowly moving on curved super-elevated track. In order to obtain this beneficial action, friction plate 132 and wear plate 134 should be positioned such that the interface therebetween is at an angle of at least 4° to the horizontal under the maximum loaded, i.e., "spring-solid" condition.

As will be observed, each support surface 96 is located a short distance above the axis of rotation of the respective axle. Accordingly, there will be a slight fore-and-aft movement of the surfaces 96 relative to the superjacent surfaces 72 and 74 during the aforementioned vertical angular or tilting movement of the wheel frames under various loading conditions. The mount assemblies 123 will accommodate this relative movement by horizontal shear deflection within the outer elastomeric blocks 124 and to some extent by similar shearing deflection within the blocks 126 as well as by sliding displacement of the wear plates 134 relative to the friction plates 132.

Swiveling restraints such as side bearings (not shown) and other known accessory components may be provided on the truck assembly disclosed herein, as desired.

A number of improved performance objectives are attainable with the truck assembly 20. These include improved curve tracking ability, improved vertical and lateral ride quality, control of wheel hunting motion, wheel load equalizing ability, convenience and simplicity of brake component mounting, simplicity and economy of construction, and relatively low operation and maintenance costs. By way of explanation of the curve tracking ability, when a loaded truck 20 enters a track curve, a lateral inward flange or flange fillet force will be generated between the leading outer wheel and respective rail. This primary force along with other force reactions developed on the other truck wheels will act as a turning couple against the turning resistance of the truck as made up of the straight running tendency of the truck and the swiveling resistances of the truck bolster relative to the supported car assembly, e.g., such as occurs at the mounting 52 and at side bearings (not shown). Because of the pivot arm length of each wheelset pivoting assembly relative to the bolster, the lateral wheel force will cause the leading wheel set pivoting assembly to pivot about its pivotal connection with the bolster in a horizontal plane by horizontal elastic shear deformation of the outer blocks 124 of each mount assembly, as well as a combination of similar elastic deformation of the inner blocks 126 and possible sliding movement between the plates 132 and 134. The initial horizontal pivoting of the lead wheel frame immediately puts the leading wheelset in an angular or truck turning and guiding relationship relative to the trailing wheelset.

Further entry of the truck 20 into a curve of substantial curvature will result in a further increase in the lead wheel lateral force and the swiveling of the lead wheelset, and finally a swiveling of the truck bolster as the noted turning resistances are overcome. As this swiveling of the bolster and thus of the side frames occurs, the swivel or pivot angle assumed by the leading wheelset assembly with respect to the car body longitudinal axis will continue to lead that of the truck bolster, i.e., be greater than that of the truck bolster 22, while traversing the track curve. Thus the lead wheelset will remain in a truck turning or guiding relationship with respect to the trailing wheelset which is essentially still trailing the truck bolster and side frame assembly. By a trailing position is meant little or no outward swiveling of the wheelset with respect to the truck frame assembly. Such a position is produced by a force couple formed by a pair of longitudinal wheel tread forces (actually components) acting on the wheels of the wheelset, such couple producing or tending to produce an inward swiveling of the wheelset. Once the truck is fully into the curve, the two wheelsets will remain in this relatively fixed turning and thus truck guiding relationship with respect to one another. In such a relative turning position, both wheelsets normally are positioned with the axes of rotation of the axles oriented approximately parallel to radii of the curve at those points, and with both outer wheels running closer to the rail than would otherwise be the case with the conventional three-piece or rigid frame type trucks. This relative turning position of the wheelsets in a curve is maintained in part by a larger rolling circumference presented by the outer lead wheel over that presented by the outer trailing wheel and in part by a lateral flange or flange fillet force provided by engagement of the flange or the flange fillet of the outer lead wheel with the rail. Any such lateral flange or flange fillet force is proportional to some angle of attack maintained between the wheel flange and the rail. However, this angle of attack is minimized, by the aforedescribed truck assembly, particularly as compared to a truck of conventional three-piece or rigid frame design.

Moreover, when a car is traversing a curve at a speed above equalibrium speed for the degree of superelevation of that curve, there is a resultant outward lateral load applied to the bolster by the car due to the unbalanced centrifugal force of the car body. This load or force acts toward displacing the bolster and side frames outward and, with the flange forces, creates a further turning couple for pivoting the wheelset pivoting assemblies.

Since each wheelset assembly has a fixed pivot, at the connection to the bolster, the relative angular movement which takes place between the wheel frames and the ends of the side frames during the turning displacements causes horizontal or shear deformation of the blocks 124 and to some lesser degree similar deformation of the inner blocks 126. The resultant stored energy in the resilient mounting blocks will generate reaction forces which inherently will tend to pivot the truck back to its normal square or straight-ahead parallel position as soon as the turning forces are removed as the truck exits from the curve onto straight or tangent track.

As will be appreciated by those skilled in this art, the various angular displacements referred to in discussing the operation of the truck unit 20 are relatively small angular values in normal operation situations. At the same time, accomplishing the relative angular movements between the components to accommodate these changes are very important to desirable operation of a railway car truck assembly.

With reference to ride quality, in effect the resilient mounts 123 become a primary suspension system, with the conventional truck springs 54 becoming a secondary suspension system. Since the side frames rest on the resilient mounts, the unsprung mass is reduced, as compared to a conventional three-piece truck. The unsprung truck mass is further reduced by the interposition of the pads 104 between the wheel frames and the bearing adaptors. Cushioning at this point is also effective toward absorbing the higher frequency, low amplitude shock and vibratory-type motion generated by the engagement of the wheel with the rail. The elastomeric non-linear spring rate characteristic of both of these sets of mounts, 104 and 123, tend to present a softer, longer travel type of spring rate suspension to the supported railway can under lightly loaded conditions than would pertain with a conventional linear spring rate type of truck spring. Another advantage of the double suspension system is the effectiveness of two different spring and damping systems in reducing the transmissibility of different ranges of shock and vibratory input forces and motion. As a further factor, the total vertical spring supported travel of the truck bolster readily can be increased. By way of example, a total vertical travel of slightly greater than 4″ is readily provided in a truck assembly 20, as compared to 3-11/16″ provided by the longest travel standard spring in a conventional freight car truck design. Also, of course, the wedge block snubbers 64 and related components tend to prevent a resonant build-up of vertical harmonic car motion as is often produced at higher train operating speeds by periodic type track input. As noted briefly above, the extra length of the wedge blocks 64 permitted by this assembly will also facilitate holding the truck bolster and side frame assembly in the maximum tram (squared) relationship, counteracting any parallelogramming tendency produced by wheel rail contact or wheel frame swiveling action on curves.

With reference to lateral ride quality, the lateral pivoting movement and cushioning of the individual wheel frame pivoting assemblies provided by the truck assembly 20 allows the wheelsets to deflect and in effect to steer around many lateral track alignment irregularities which amount to short length sharp curvatures in the rail. This is accomplished with a significant reduction in the transmissibility of such wheel motion to the car body. Moreover the disclosed and described truck design limits the generation and transmission to the truck frame and car body of the hunting motion inherent in the use of "coned" wheels. This is attained by permitting a degree of turning motion between the truck axles, with that motion being permitted and controlled by the smooth spring-type restraint of the assemblies 123, which provides creep damping by creep action between the individual wheel treads and the rails in a recognized manner. In the event any wheel hunting motion is developed, the wheel bearing adaptor pads 104 will allow the limited amount of lateral wheelset hunting motion while transmitting only a portion of that motion to the truck frame and car body. Lateral stability of the wheel frames to any transmitted wheel hunting motion also is provided by the Coulomb damping action of the friction-rubbing of the plates 132 on the wear plates 134 in the event of any relative longitudinal or lateral movement occurring between the wheel frames and the side frames.

The wide spacing of the side frames obtained in placing the side frames outboard of the wheel bearings provides a relatively wide spring base which enhances lateral roll stability of the car body by reducing the leverage effect of the car body on the truck spring system. This wide spacing also increases the relative motion between the truck bolster and the side frame wedge blocks 64, thereby enhancing the Coulomb damping effect of these blocks attendant upon any tendency to lateral harmonic roll motion of the car as is often produced by periodic type track input motion at certain lower critical car operating speeds. The bolster 22 is of generally conventional basic construction, except for the noted features.

While accomplishing the various other noted benefits, the described truck assembly 20 retains the characteristic of good wheel load equalizing ability normally associated with conventional three-piece truck designs. The rocking ability of the side frames with respect to the truck bolster to permit an individual wheel to rise and fall in accordance with the vertical track irregularities is maintained through the univeral ball and socket connections of the wheels assemblies to the bolsters. Moreover, since the wheel frame members are attached to and move wth the individual wheelsets, except for the very small degree of movement afforded by the pads 104, the wheel frames provide excellent bases for mounting brake equipment (not shown), thus permitting a truck mounted braking system which will not interfere with the steering or spring cushioning functions of the truck.

The truck assembly 20 further possesses advantages of simplicity and economy. In each instance, a bolster and two side frame members are used, similar to conventional three-piece trucks, and as such incorporate most of the economical construction features which have been developed over the years for trucks of such designs. The wheel frame members may be one piece castings, including such components as the wheel-bearing pedestals and pedestal arms as well as the balls of the ball and socket connections. The socket recesses may be cast into the truck bolsters. The elastomeric seat members avoid requirements for lubricating contacting surfaces and eliminate the need for accurate machining of mating components. The mount assemblies 123 may be produced as separate units for easy and economical replacement of the assemblies within the truck assembly. The wheelset assemblies may be of conventional design, with standard bearings and bearing adaptor assemblies. Standard long travel springs as specified by the Association of American Railroads also may be utilized for springs 54, while other components such as the elastomeric bearing adaptor pads 104 may be components which are now produced commercially for standard types of trucks.

The various design features provided by the described truck assembly also contribute to low operation and maintenance costs. By way of one specific example, improved truck steering performance will increase the service life of the wheels, thereby reducing wheel dressing and replacement costs.

Referring now to FIGS. 8–15, the truck assembly 220 shown in those figures also is an articulated freight car truck and provides most of the advantages of the truck 20. In addition, the assembly 220 provides two other potentially advantageous features by way of a truck frame configuration more similar to that of the existing conventional freight car truck and fitting within the underframe spacing of all or at least most existing freight cars, and a pivotal connection of the wheel frame members to a fourth truck frame member in place of a direct connection to the truck bolster. The manner of attachment and restraint of the wheelset pivoting assemblies within the truck frame assembly is similar to that of the truck 20 and the basic principles of operation are the same. However, the assembly 220 generally uses a somewhat more elaborate and complex form of truck frame construction.

Truck 220 comprises a bolster 222, a transom 223, two unitary side frame members 224 and 226, and two wheelset pivoting assemblies 228 and 230. The assembly 228 includes a wheel frame 232 in which is journaled a wheelset 234 comprising an axle 236 to which are fixed wheels 238 and 240 and assembly 230 includes a wheel frame 242 in which is journaled a wheelset 244 comprising an axle 246 with wheels 248 and 250 affixed in the same general manner as in truck 20. The bolster 222 includes a conventional center bearing structure 252, and the side frames include end sections 260 and 262 extending for bearing support on the respective wheelset pivoting assemblies, also in the same general manner as in truck 20. The bolster 222 and transom 223 form the transverse center support in a form sometimes referred to herein as a bolster/transom assembly, with the bolster and related springs 254 contained and supported within the transom member.

Figure 9:
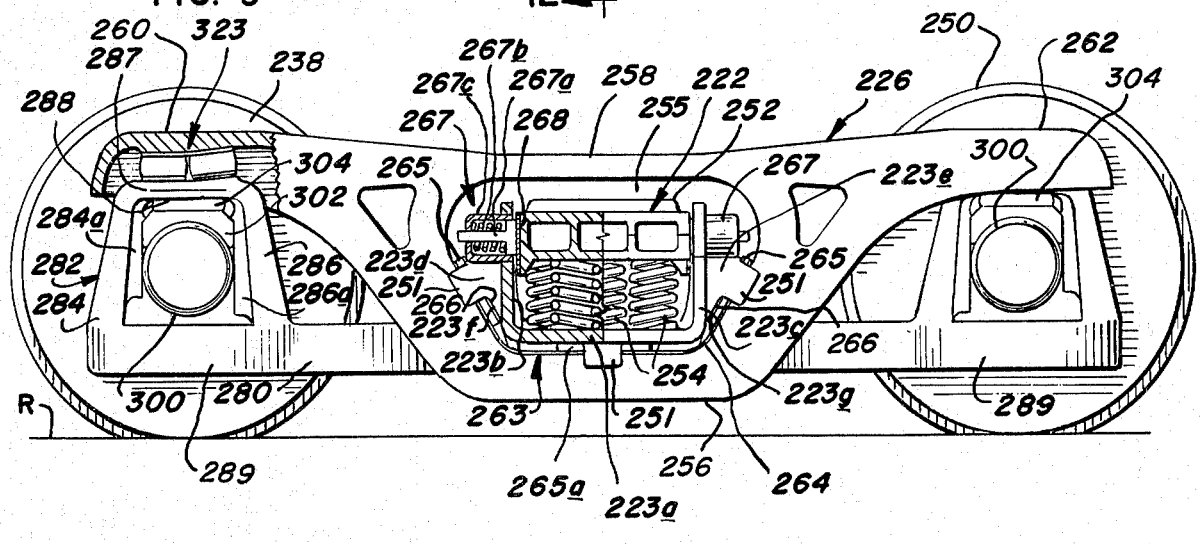
Figure 10:
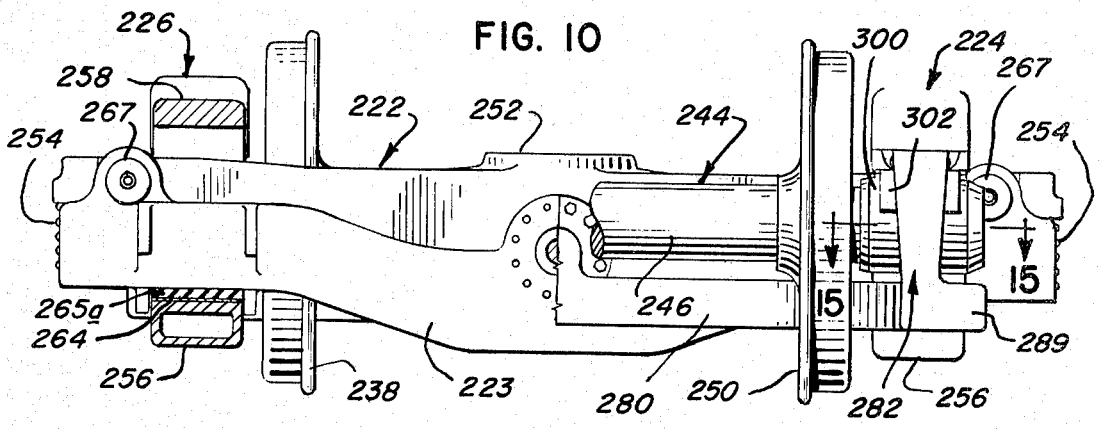
Figure 11:
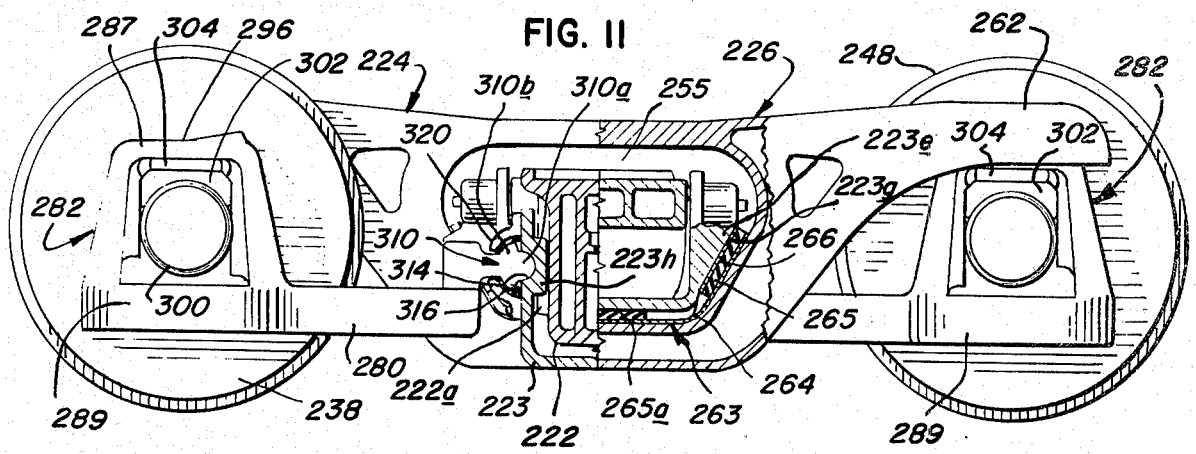
FIG. 11 is another side view, also partially in section, of the truck of FIG. 8 taken generally along the irregular line 11—11 of FIG. 8.
Figure 12:
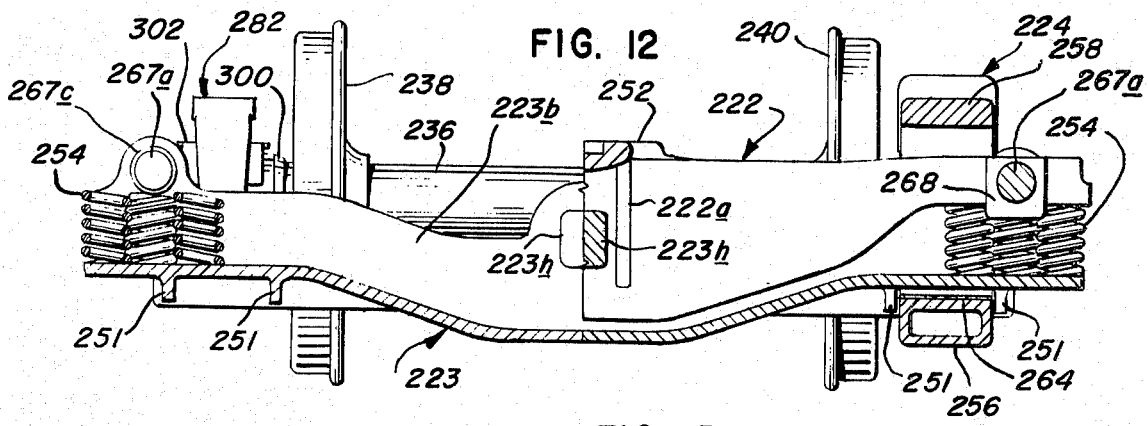
FIG. 12 is a sectional view of the truck of FIG. 8 taken along the irregular line 12—12 of FIG. 8.

Referring particularly to FIGS. 9, 11 and 12, the transom 223 is a generally channel-shaped member having a bottom web **223*a* and side flanges 223*b* and 223*c*, and is supported by its ends being held or cradled within bolster/transom openings 255 provided in the generally truss-shaped side frame members 224 and 226, between chords 256 and 258. Near each end, the transom 223 includes a flat lower surface of web 223*a* and two opposite side extensions 223*d* and 223*e* having outer angularly extending support surfaces 223*f* and 223*g*, e.g., at opposite angles of inclination of about 30° to the horizontal. Each such set of end support surfaces on the transom is received by an elastomeric pad assembly 263 interposed between the noted end support surfaces of the transom and the adjacent generally parallel support surfaces of the respective side frame as shown. Each pad assembly 263 is composed of a continuous connecting plate 264, two elastomeric pads 265 sandwiched and bonded between two side bearing plates 266 and the connecting plate 264 on the inclined portions of the plate, and a third elastomeric pad 265*a* bonded to the bottom middle portion of the connecting plate 264. Each such elastomeric pad assembly is installed in the bolster/transom opening 255 of the respective side frame member 224–226 with the plate 264 mounted on the side frame support surfaces, and with the side plates 266 receiving the two inclined mount surfaces 223*f* and 223*g* and pad 265*a* receiving the flat lower mounting surface of web 223*a* of the transom member. This inclined support surface arrangement will tend to hold the truck frame in a square or trammed configuration, and the elastomeric pads 265 and 265*a*** will accommodate relative rocking motion of the side frames for vertical wheel load equalizing movement.

Sprng-loaded friction plate and stem units 267 are mounted in vertical wall portions **223*b* and 223*c* of the transom member. Each unit 267 comprises a plate and stem member 267*a* and a compression spring 267*b* within a housing 267*c* which is installed within the transom member. Such units are available commercially and have been used for "stabilizing" older unstabilized conventional trucks. The plate portions of members 267*a* bear on wear plates 268 installed on the sides of truck bolster ends as shown. An opposed pair of such plate and stem units 267 as installed maintain a relatively constantly normal force between the plates 267*a*** and the truck bolster for assistance in snubbing or damping vertical and lateral truck spring movement of the bolster relative to the transom.

Gib-like extension 251 on the inclined and flat bottom portions of the transom member straddle and restrict the side frames in a given laterally spaced relationship with relation to the bolster/transom assembly. Referring to FIG. 12, a pair of opposed inwardly extending bosses **223*h* are cast on the vertical wall portions or flanges 223*b* and 223*c* of the transom 223, in a midpoint position. Each of these bosses 223***h* extends between a pair of corresponding parallel vertical ribs 222*a* cast onto the adjacent vertical side face portion of the bolster 222. The ribs 222*a* restrict the lateral motion of the bolster relative to the transom resulting from truck spring lateral deflection.

Figure 8:
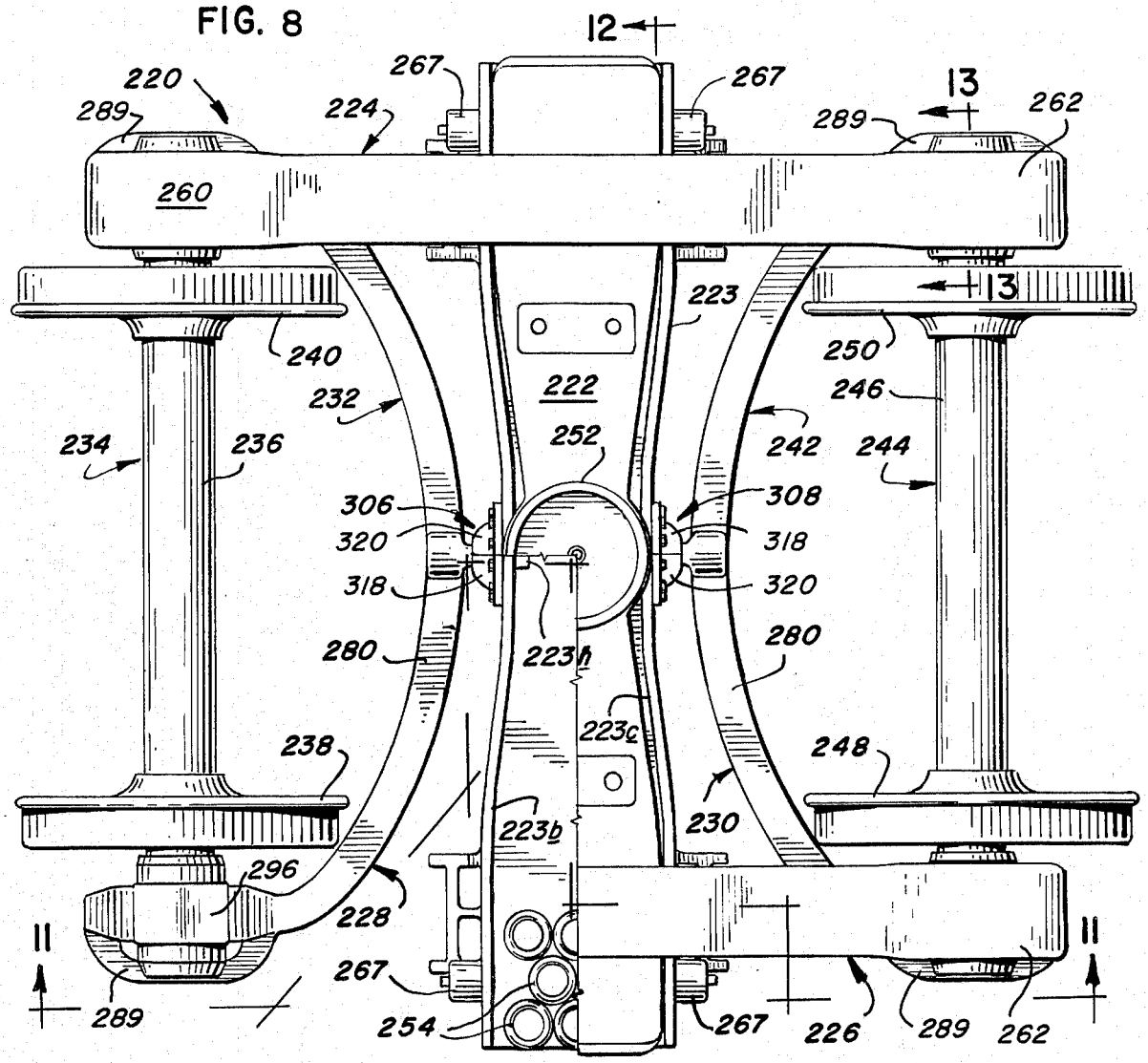
FIGS. 8, 9, 10, 13 and 14 are views corresponding generally to FIGS. 1, 2, 3, 5 and 6, respectively, illustrating another embodiment of a railway truck employing teachings of this invention.

The length of the truck bolster 222 is extended beyond that of the conventional three-piece truck and a wider spring base is obtained by use of the transom member 223. As best seen in FIGS. 8 and 12, the main truck springsets 254 are positioned outboard of the centerlines of the side frames. Also the length of the side frames and the truck wheel base may be extended beyond that of a conventional truck.

Each wheel frame 232 and 242 includes a yoke or C-shaped main frame section 280 with a saddle and pedestal opening portion 282 at each end for engaging the respective wheelsets and side frame supports. Each saddle portion 282 includes two vertical sections 284 and 286 and a top section 287. A pedestal surface 288 on the underside of each top section 287 along with pedestal arm extensions 284*a* and 286*a* on the respective vertical sections 284 and 286 form a wheel bearing pedestal opening for receiving and engaging a wheel bearing 300 with a bearing adaptor 302 and an elastomeric pad 304. A horizontal side bar section 289 joins the lower ends of each pair of sections 284 and 286 to strengthen the saddle and pedestal opening portion 282.

Each wheel frame 232 and 242 is attached within the four-piece side frame and bolster/transom truck assembly in a manner to permit vertical and lateral pivotal movement of the wheelset pivoting assemblies 228 and 230 about pivot connections at midpoint positions on the respective sides 223*b* and 223*c* of the transom member.

Ball and socket assemblies 306 and 308 form the pivot point attachment between the respective wheel frames and the transom member. Each ball portion 310 is cast integrally with the wheel frame and is composed of two different size spherical halves as showin in FIG. 11. An inner portion 310*a* of each ball is of smaller diameter than an outer half portion 310*b* to reduce the overall longitudinal spacing required by the ball joint mechanism. The inner half portion 310*a* has a machined surface and is received in a corresponding machined socket 314 formed within the respective vertical side wall of the transom member. The outer portion 310*b* of each ball is engaged by two ball retainer castings 318 and 320 which are secured to the side face of the transom member but are separated from the ball surface by a spherically-shaped elastomeric seat element 316.

Figure 14:
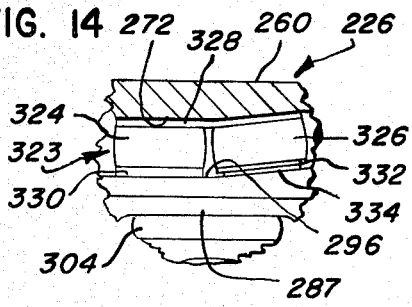
Figure 15:
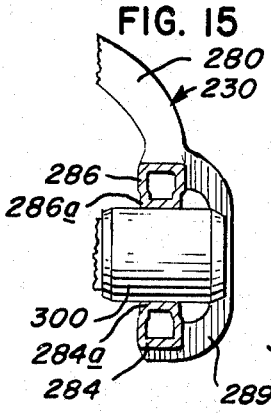
FIG. 15 is a sectional view taken along line 15—15 of FIG. 10.
Figure 13:
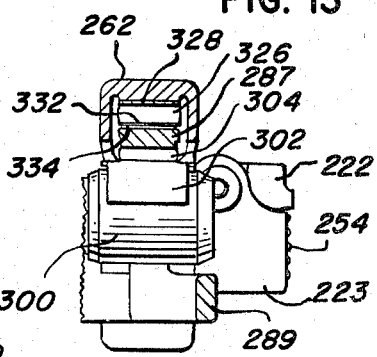

Elastomeric mount assemblies 323 provide resilient attachment and support between the wheel frames and the side frames at each of the four corners of the truck 220. Referring particularly to FIGS. 9 and 14, each mount assembly 323 comprises two block components 324 and 326, each of which is generally flat-shaped in that it is of a uniform vertical thickness, having generally parallel upper and lower ends. The outer block 324 is bonded to both upper and lower mounting plates 328 and 330 and is oriented in a horizontal position. Each plate 328 is affixed to the lower surface, e.g., 272, of the respective side frame, and each plate 330 is affixed to the upper surface 296 of the respective saddle portion 282 of the wheel frame. The inner block 326 is bonded to the common mounting plate 328 on the upper surface, and is oriented in a somewhat tilted position sloping downward in an outward direction taken with relation to a transverse truck center line plane, e.g., at an angle on the order of 5°. On the lower surface, block 326 is bonded to a separate friction plate 332 which bears and slides on a corresponding wear plate 334 installed on an inclined mounting portion of the upper surface 296 of the respective saddle and pedestal opening portion 282.

The outer elastomeric block component 324 of the side frame/wheel mount 323 provides smooth spring elastic restraint between the side and wheel frame members in a horizontal plane in both longitudinal and lateral directions. The inner block component 326 also provides a degree of similar elastic restraint in a horizontal plane between the before-mentioned members but acting in combination with frictional sliding restraint as provided by the friction plate 332 acting on the wear plate 334 of the wheel frame member. Because the mount assembly 323 is a load carrying member, the normal force developed between plates 332 and 334 and thus the frictional force and Coulomb damping produced by sliding motion between these plates will be proportional to truck loading. Moreover, because of the tilted orientation of the inner block component 326 and the plates 332 and 334, relative sliding motion between these plates will also be somewhat preferential in the direction of inward motion of the wheel frame relative to the truck frame, as noted above with respect to truck 20. This effect will tend to oppose any curve outward steering tendency of the linkage system of this truck when the car is standing or slowly moving on curved super-elevated track.

Because the wheel frames are pivotally connected to the transom member rather than to the bolster in truck 220, the wheel frames will not assume significantly different angular positions under different car loadings and related truck spring and bolster height deflections. The only tilting of the wheel frames will be that due to the compressive deflection of the mounts 323. For this truck design, the total range of such tilting deflection of the wheel frames is estimated to be about 1° for a total range of truck loading from spring free to spring solid conditions. Such a degree of angular deflection of the wheel frame member may be accommodated by the elastomeric block components 324 and 326 without producing a significant non-uniform vertical stress distribution within the mount assemblies 323. Thus by a centered positioning of the mount assemblies 323 over the wheelset axles, a relatively balanced loading can be maintained on the wheel frame member over the entire design load range of the truck as is the case with the support design of truck 20, and the ball and socket connection between wheel frame and truck transom need be designed to withstand substantially only those loadings produced by wheel braking, car coupling impact, and wheel frame articulation movement.

As with truck 20, it may be desirable to control the load distribution across each mount assembly 323 at specified loading conditions, for example to maintain a greater proportion of the load on inner blocks 326 under light car loading conditions to enhance the noted damping effect obtained through plates 332 and 334 under that load condition. This enhancement may be accomplished with this truck 220 by utilizing the slight tilting of the wheel frames over the range of truck loading mentioned above. For instance, in a preferred design wherein the surfaces 296 are parallel to the opposed surfaces 270 and 272 under fully loaded conditions, the surfaces 296 will diverge slightly from the respective opposed surfaces 270 and 272 under light loading conditions, thereby resulting in a greater proportion of the loading being carried by inner blocks 326 under such light loading conditions.

The operation or performance of truck 220 is quite similar to that of the truck 20 in meeting the objectives of superior tracking ability, good ride quality, good lateral roll stability, and good control of wheel hunting motion, and will not be described here in any detail. It may be noted, however, that with truck 220, the wheelset pivoting produced when the supported car is traversing a curve at a speed above the equilibrium speed for that curve will be that due only to the resultant lateral displacement of the side frames with relation to the wheel frames. There is no added component of wheel frame pivoting produced by any lateral displacement of the bolster with relation to the truck side frames as permitted by truck spring lateral deflection, such as is possible with the truck 20. This difference arises from the fact that in truck 220 pivotal connection for the wheel pivot assemblies is to the transom member instead of to the truck bolster. Avoiding a direct coupling between the bolster and wheel frames also will avoid any lateral dynamic instability problems arising from any possible lateral oscillation of the bolster with the car body.

The mount assemblies 263 also afford further vertical elastomeric cushioning in truck 220. The pivotal connection of the wheel frames to the transom member may result in a somewhat shorter pivot arm length for the wheel frames in truck 220 as compared with a connection to the bolster side faces as in truck 20.

The yieldable elements of the support assemblies joining the side frames and wheelset pivoting assemblies of trucks 20 and 220 preferably are of elastomeric materials such as appropriate natural or synthetic rubbers, because of the spring characteristics readily afforded by members formed of such materials and because of economy. Obviously, the dimensions of these blocks will be determined by the characteristics of particular materials selected and the operational parameters anticipated. To those skilled in the design and application of coil-type springs, it should be apparent that an approximate duplication of the elastomeric mount assemblies is possible using coil springs, even as to the wedge-shaped mount of truck 20. Such would be possible using a parallel arrangement of a plurality of coil springs replacing each of the wedge-shaped elastomeric block elements, with these springs adequately secured at each end to the respective plates. The springs could each have a curved spring axis in the free state and oriented in the outward diverging direction of the mount when assembled, also being of the proper number of coils, diameter, and rod size. The decreased vertical and lateral stiffness of the thicker vertical diverging portions of each elastomeric block would be simulated by springs of increased number of coils. The greater the number of springs used, up to a point limited by the slenderness of the springs, the better the possible approximation of the elastomerically constructed mount. A corresponding duplication of the flat-shaped elastomeric mount assemblies would be possible using a parallel arrangement of coil springs all of the same free height, diameter, coil size and number of coils, and having a straight spring axes. However, such coil spring units would result in increased costs over the elastomerically constructed mount. Also, increased problems would be encountered in obtaining a positive connection between the ends of the springs and the mounting plates.

Many other embodiments may be devised utilizing the teachings of this invention. By way of one example, the configuration of the side frames may be varied. For instance, a truck designed to meet current clearance outline standards of the Association of American Railroads may be more readily provided by using side frames of a simple beam design, as distinguished from the described truss designs, to minimize the depth of the side members and related assemblies. The illustrated truss designs are preferred from a standpoint of strength and ecomony of materials. The truss and bolster design as in truck 20 also may be readily modified to permit use of a so-called Barber stabilized-type truck damping arrangements, i.e., the wedge block is installed in the bolster and the wedge spring also serves as a load carrying spring beneath the bolster.

As another example, a so-called "spring-plank" may be provided beneath the bolster in a truck using a bolster, side frames and wheel frame assemblies similar to truck 20, with the plank member being supported on both side frames and having gib-like extensions straddling each side frame for securing the side frames and spring-plank together, the plank being of sufficient torsional flexibility to accommodate the wheel load equalizing movement between the side frames. In such an embodiment, the bolster may be spring supported on the plank with the snubbing of the bolster spring movement occurring between the bolster and the side frames similar to truck 20. However, the wheelset pivoting assemblies of such a spring-plank embodiment may be pivotally connected to brackets installed on opposite sides of the midportion of the spring-plank, and the resilient support connections between the side frames and wheel frames may be of the flat-shaped block design, as in the corresponding features of truck 220.

It will be obvious that other modifications of the specific embodiments shown and described may be made, particularly by those skilled in the art, without departing from the spirit and scope of this invention.

It will be seen that railway truck assemblies have been provided which meet the aforestated objects.

While particular embodiments of this invention are shown and described herein, it will be understood, of course, that the invention is not to be limited thereto since many modifications may be made by those skilled in the art, particularly in light of the foregoing teachings. It is contemplated, therefore, by the appended claims, to cover any such modifications as fall within the true spirit and scope of this invention.

What is claimed is:

1. A railway truck comprising a truck assembly for supportably engaging a railway vehicle, said assembly including a transverse center structure and rigid side members having portions disposed on opposite sides of each end of said center structure, each of said side member portions being spaced longitudinally of said assembly from said center support structure, a pair of pivot assemblies disposed one on each side of said center structure for supporting said truck assembly, each of said pivot assemblies including a pair of transversely spaced wheels connected by an axle and a wheel holding frame means supported on said axle and extending in underlying relation to said side member portions on the respective side of said center structure, support means positioned between each of said side member portions and the respective underlying wheel holding frame means and including compressive resilient means between and joined to the respective side member portion and underlying wheel holding frame means for providing cushioned support of said side member portions on said pivot assemblies and permitting relative movement between said side member portions and underlying wheel holding frame means longitudinally and laterally of said truck assembly by resilient deformation of said resilient means, and each of said pivot assemblies being connected to said center structure through a pivot connection spaced from the axis of rotation of the respective pair of wheels and allowing limited pivotal movement in all directions between the respective pivot assembly and said center structure, said pivot assemblies supporting said truck assembly and each having horizontal pivotal movement about the respective pivotal connection to said center structure for automatic steering adjustment of said pivot assemblies relative to said truck assembly by such resilient deformation of said resilient means in response to track curve conditions encountered by said truck whereupon said resilient means provide restoring forces for returning each pivot assembly to a predetermined alignment position relative to said truck assembly.

2. A railway truck as in claim 1 wherein each of said support means includes a elastomeric member having its upper surface affixed to the respective side member portion and its lower surface affixed to the respective underlying wheel holding frame means to transmit compressive loads from the respective side portions to the respective underlying wheel holding frame means through said elastomeric member.

3. A railway truck as in claim 2 wherein each of said support means includes a further assembly comprising an elastomeric component, a member affixed on one side to one end of said component and having an outer contact surface, and a further component having a surface in sliding contact engagement with said outer surface, said further assembly being positioned adjacent the respective elastomeric member and oriented to transmit compressive loads from the respective side member portion to the respective wheel holding frame means through said elastomeric component and the interface between said surfaces.

4. A railway truck as in claim 3 wherein each of said support means includes: an upper plate; the upper surfaces of said elastomeric member and said elastomeric component being bonded to said upper plate; said upper plate being affixed to the respective side member portion; the lower surface of said elastomeric member being bonded to a first lower plate; the lower surface of said elastomeric component being bonded to a second lower plate; a third lower plate in sliding abutting relation to the lower surface of said second lower plate; and said first and third lower plates being affixed to the respective underlying wheel holding frame means.

5. A railway truck as in claim 3 wherein said sliding contact interface of each of said support means is at an angle relative to a horizontal reference and extends downwardly in a direction away from said center structure.

6. A railway truck as in claim 5 wherein said elastomeric member and said elastomeric component are generally flat-shaped blocks having generally parallel upper and lower end surfaces being the loading surfaces.

7. A railway truck as in claim 5 wherein said elastomeric member and said elastomeric component of each of said support members are generally wedge-shaped blocks having upper and lower surfaces diverging from one another in a direction away from said center structure.

8. A railway truck as in claim 5 wherein each of said side member portions and respective underlying wheel holding frame means include generally parallel spaced horizontal surfaces and generally parallel spaced inclined surfaces extending downwardly in a direction away from said center structure, said elastomeric member of each support means having parallel upper and lower end surfaces affixed to the respective spaced horizontal surfaces, said further assembly of each of said support means comprising an elastomeric component having parallel upper and lower end surfaces and a first flat plate affixed to one of said end surfaces, the other of said end surfaces of said component being affixed to one of the respective spaced inclined surfaces, and each of said further assemblies including a second flat plate affixed to the other of the respective spaced inclined surfaces and in compressive contact with the outer surface of said first plate.

9. A railway truck as in claim 1 wherein each of said adjacent wheel holding frame means is disposed in superposed relation to the axis of rotation of the wheels of the respective pivot assembly and each of said resilient means comprising an elastomeric mount positioned between the respective side member portion and underlying wheel holding frame means and centered above the respective wheel axis for balanced distribution of the transmitted loads on each side of such axis.

10. A railway truck as in claim 1 wherein each of said wheel holding frame means of said pivot assemblies is a unitary frame member extending adjacent the respective pivot connection and extending beneath each of the respective side member portions.

11. A railway truck as in claim 10 wherein each of said pivot assemblies comprises a wheelset including the respective pair of wheels and axle and having wheel bearings positioned outwardly of said wheels, and each of said frame members comprising a pair of transversely spaced bearing portions disposed on the outward sides of said wheels for engaging said bearings, and a load bracket extending outwardly of each such bearing engaging portion, each of said support means being joined to one of said load brackets.

12. A railway truck as in claim 10 wherein each of said frame members comprises a pair of transversely spaced bearing portions for engaging a wheelset which includes the respective pair of wheels and axle, each of said bearing portions defining a pedestal opening and including a bearing surface across the upper end of each such opening, each of the wheelsets including wheel bearings and bearing adaptors engaged in said pedestal openings of the respective frame member, and elastomeric pads between each of said adaptors and said upper surface of the respective pedestal opening.

13. A railway truck as in claim 1 wherein said side members comprise a pair of spaced parallel side frames, opposite end portions of each side frame being disposed over the respective underlying wheel holding frame means and engaging said support means, said transverse center structure being connected to and supported on mid-portions of said side frames and including a bolster member extending between said side frames, and springs supporting said bolster member.

14. A railway truck as in claim 13 wherein said springs are provided beneath each end of said bolster and are supported on said side frames, said pivot assemblies being pivotally connected to said bolster.

15. A railway truck as in claim 14 wherein each of said support means comprises an elastomeric mount positioned between and affixed to the respective side frame end portion and underlying wheel holding frame means.

16. A railway truck as in claim 15 including ball and socket components pivotally connecting each of said pivot assemblies to the respective adjacent sides of the mid-portion of said bolster.

17. A railway truck as in claim 15 and wherein each of said side frames is of a truss design including spaced upper and lower chord sections in the mid-portion thereof and spaced struts joining said upper and lower chord sections and defining a bolster opening therebetween, opposite ends of said bolster being received in said bolster openings of said side frames.

18. A railway truck as in claim 17 including wedge blocks supported in each of said side frames at each side of said bolster, each of said wedge blocks being engaged between one of said struts and the respective adjacent side of said bolster and having one surface in sliding frictional contact with such respective adjacent side of said bolster, and springs urging said wedge blocks into such frictional contact positions.

19. A railway truck as in claim 1 wherein said transverse center structure includes a bolster member extending between said side members, springs supporting said bolster member for vertical movement relative to said side members, said pivot assemblies being pivotally connected to said bolster member, and wherein said compressive resilient means of each of said support means includes first and second portions, end of said second portions being disposed outwardly of the respective first portion relative to said center structure, and each of said second portions being of greater vertical height than the respective first portion.

20. A railway truck as in claim 19 wherein said compressive resilient means comprises a pair of wedge-shaped elastomeric block members between each of said side member portions and the respective underlying wheel holding frame means, the upper end of each of said block members being affixed to the respective side member portion, the lower end of one of said block members of each pair being affixed to the respective underlying wheel holding frame means, a plate member affixed to the lower end of the other of said block members of each pair and having an outer contact surface, each of said wheel holding frame means including a surface in sliding contact engagement with said outer contact surface, and the sliding contact interface between said surfaces being disposed at an angle to the horizontal and extending downwardly in a direction away from said center structure.

21. A railway truck as in claim 19 wherein said compressive resilient means comprise elastomeric blocks.

22. A railway truck as in claim 21 wherein said blocks are wedge shaped.

23. A railway truck comprising a truck assembly for supportably engaging a railway vehicle; said assembly including a transverse center structure and a pair of spaced parallel rigid side frames having portions disposed on opposite sides of each end of said center structure; a pair of wheelsets disposed one on each side of said center structure; and resilient means for supporting said side frames on said wheelsets and permitting relative movement between said side frames and said wheelsets longitudinally and laterally of said truck assembly by resilient deformation of said resilient means; each of said side frames being of a truss design including a lower chord section in the mid-portion thereof; each of said lower chord sections including inclined downwardly converging upper surfaces and a generally horizontal flat surface between the lower ends of the respective converging surfaces; said center structure including a transom extending between and connected to said side frames, a bolster member extending between said side frames, and springs supporting said bolster member on said transom; said transom having inclined, downwardly converging outer side surfaces and a generally horizontal flat surface between the lower ends of the respective side surfaces adjacent each end thereof and disposed in registry with the respective inclined chord surfaces and flat surfaces of said side frames; a resilient support interposed between each of said inclined surfaces and horizontal surfaces of said chord sections and the respective adjacent inclined transom side surface or horizontal surface for supporting said transom on said side frames; and each of said wheelsets being connected to said transom through a pivot connection spaced from the axis of rotation of the respective pair of wheels and allowing limited pivotal movement in all directions between the respective wheelset and said center structure.

24. A railway truck as in claim 23 wherein each of said resilient supports between said transom and said side frames comprises an elastomeric pad.

25. A railway truck as in claim 24 wherein said transom includes vertical side wall portions, and friction units mounted at the ends of said transom in said wall portions adjacent corresponding sides of said bolster, each of said friction units including a friction plate in sliding friction contact with the respective adjacent side of said bolster and a spring urging said plate against said bolster side.

26. A railway truck as in claim 23 wherein said transom is a rigid transom member.

27. A railway truck as in claim 26 wherein each end of said transom member extends beyond the respective side frame, said springs supporting said bolster member on said transom member being disposed outboard of the centerline of each of said side frames.

28. A railway truck comprising a truck assembly for supportably engaging a railway vehicle; said assembly including a pair of spaced parallel rigid side frames and a transverse center support structure; said support structure including a transverse support member connected to and supported on mid-portions of said side frames, a bolster, and springs supporting said bolster on said transverse member; each of said side frames having end portions spaced longitudinally of said assembly from said center support structure; a pair of pivot assemblies disposed one on each side of said center structure for supporting said truck assembly, each of said pivot assemblies including a pair of transversely spaced wheels connected by an axle and a wheel holding frame means supported on said axle and extending in underlying relation to said end portions of said side frames, on the respective side of said center structure; support means positioned between each of said side frame end portions and the respective underlying wheel holding frame means and including compressive resilient means between and joined to the respective side frame end portion and underlying wheel holding frame means for providing cushioned support of said side frames on said pivot assemblies and permitting relative movement between said side frame end portions and underlying wheel holding frame means longitudinally and laterally of said truck assembly by resilient deformation of said resilient means; and each of said pivot assemblies being connected to said transverse member through a pivot connection spaced from the axis of rotation of the respective pair of wheels and allowing limited pivotal movement in all directions between the respective pivot assembly and said transverse member, said pivot assemblies supporting said truck assembly and each having horizontal pivotal movement about the respective pivotal connection to said transverse member for automatic steering adjustment of said pivot assemblies relative to said truck assembly by such resilient deformation of said resilient means in response to track curve conditions encountered by said truck whereupon said resilient means provide restoring forces for returning each pivot assembly to a predetermined alignment position relative to said truck assembly.

29. A railway truck as in claim 28 wherein each of said support means comprises an elastomeric mount positioned between and affixed to the respective side frame end portion and underlying wheel holding frame means.

30. A railway truck as in claim 29 and wherein each of said side frames is of a truss design including spaced upper and lower chord sections in the mid-portion thereof and spaced struts joining said upper and lower chord sections and defining a bolster opening therebetween, opposite ends of said transverse support member and said bolster being received in said bolster openings of said side frames.

31. A railway truck as in claim 30 including means supported adjacent each side of each end of said bolster and having sliding frictional contact with the respective adjacent side of said bolster for snubbing relative lateral and vertical movement between said bolster and said side frames.

32. A railway truck as in claim 28 wherein each end of said transverse support member extends beyond the respective side frame, said springs between said transverse support and said bolster being disposed outboard of the centerline of each of said side frames.

* * * * *

UNITED STATES PATENT AND TRADEMARK OFFICE

CERTIFICATE OF CORRECTION

PATENT NO. : 4,003,316

DATED : January 18, 1977

INVENTOR(S) : Dale E. Monselle

It is certified that error appears in the above-identified patent and that said Letters Patent are hereby corrected as shown below:

Column 5, line 18, "sphericallyshaped" should read -- spherically-shaped --; Column 9, line 68, "can" should read -- car --; Column 12, line 58 "constantly" should read -- constant --;

Column 15, line 5, "loading" should read -- load --; Column 17, line 30 (Claim 2), "a elastomeric" should read -- an elastomeric --; and Column 19, line 38 (Claim 19), "end of said" should read -- each of said --.

Signed and Sealed this

Seventeenth Day of May 1977

[SEAL]

*Attest:*

RUTH C. MASON
*Attesting Officer*

C. MARSHALL DANN
*Commissioner of Patents and Trademarks*